US006394510B1

(12) United States Patent
Stewart, III

(10) Patent No.: US 6,394,510 B1
(45) Date of Patent: May 28, 2002

(54) SLIDING DOOR LOCKING SYSTEM

(76) Inventor: Kenneth G. Stewart, III, P.O. Box 1117, Sarasota, FL (US) 14230

( * ) Notice: Subject to any disclaimer, the term of this patent is extended or adjusted under 35 U.S.C. 154(b) by 0 days.

(21) Appl. No.: 09/523,728

(22) Filed: Mar. 13, 2000

Related U.S. Application Data

(60) Provisional application No. 60/123,863, filed on Mar. 12, 1999.

(51) Int. Cl.[7] ..... E05C 17/36

(52) U.S. Cl. ..... 292/288; 292/264; 292/DIG. 46

(58) Field of Search ..... 292/288, 289, 292/290, DIG. 30, 46, 258, 294

(56) References Cited

U.S. PATENT DOCUMENTS

| | | | | | |
|---|---|---|---|---|---|
| 705,529 | A | | 7/1902 | Hicks | |
| 1,069,079 | A | | 7/1913 | Voight | |
| 1,845,458 | A | | 2/1932 | Walton | |
| 3,490,802 | A | * | 1/1970 | Zeit | 292/145 |
| 3,810,666 | A | | 5/1974 | Hatcher | |
| 3,863,470 | A | * | 2/1975 | Imer | 70/100 |
| 3,869,887 | A | | 3/1975 | Zeit | |
| 3,930,678 | A | | 1/1976 | Alexander | |
| 4,054,308 | A | | 10/1977 | Prohaska | |
| 4,062,576 | A | * | 12/1977 | Jennings et al. | 292/258 |
| 4,073,523 | A | * | 2/1978 | Long | 292/264 |
| 4,102,545 | A | * | 7/1978 | Jay | 292/57 |
| 4,148,508 | A | | 4/1979 | Adair | |
| 4,379,576 | A | * | 4/1983 | Blough et al. | 292/205 |
| 4,630,853 | A | | 12/1986 | Bell | |
| 4,875,349 | A | * | 10/1989 | Girad | 70/95 |
| 5,120,094 | A | * | 6/1992 | Eaton et al. | 292/159 |
| 5,203,596 | A | | 4/1993 | Stevens | |
| 5,234,239 | A | * | 8/1993 | Allenbaugh | |
| 5,294,159 | A | * | 3/1994 | Corrigan | 292/258 |
| 5,431,461 | A | * | 7/1995 | Andersen et al. | 292/259 |
| 5,462,323 | A | * | 10/1995 | Benninger | 292/292 |
| 5,499,517 | A | * | 3/1996 | McCraw | 70/95 |
| 5,685,582 | A | * | 11/1997 | McCartney | 292/339 |
| 6,070,918 | A | * | 6/2000 | Calvache | 292/DIG. 46 |

* cited by examiner

*Primary Examiner*—Anthony Knight
*Assistant Examiner*—André L. Jackson
(74) *Attorney, Agent, or Firm*—Barnes & Thornburg

(57) ABSTRACT

A sliding door locking system which provides a connection between a sliding door and a fixed track in which the door slides to prevent relative movement of the sliding door with respect to the track along the X, Y, and Z axes.

20 Claims, 5 Drawing Sheets

SLIDING DOOR LOCKING SYSTEM

Applicant claims priority of previous application Ser. No. 60/123,863. filed Mar. 12, 1999.

BACKGROUND AND SUMMARY OF THE INVENTION

The present invention relates to a sliding door locking system and particularly to a locking system for use near the intersection of two sliding doors. More particularly, the present invention relates to a mechanical device which provides a connection between a sliding door and a fixed track in which the door slides to prevent relative movement of the sliding door with respect to the track along the X, Y, and Z axes.

Other objects, advantages and novel features of the present invention will become apparent from the following detailed description of the invention when considered in conjunction with the accompanying drawings.

DETAILED DESCRIPTION OF THE DRAWINGS

Figure 1:
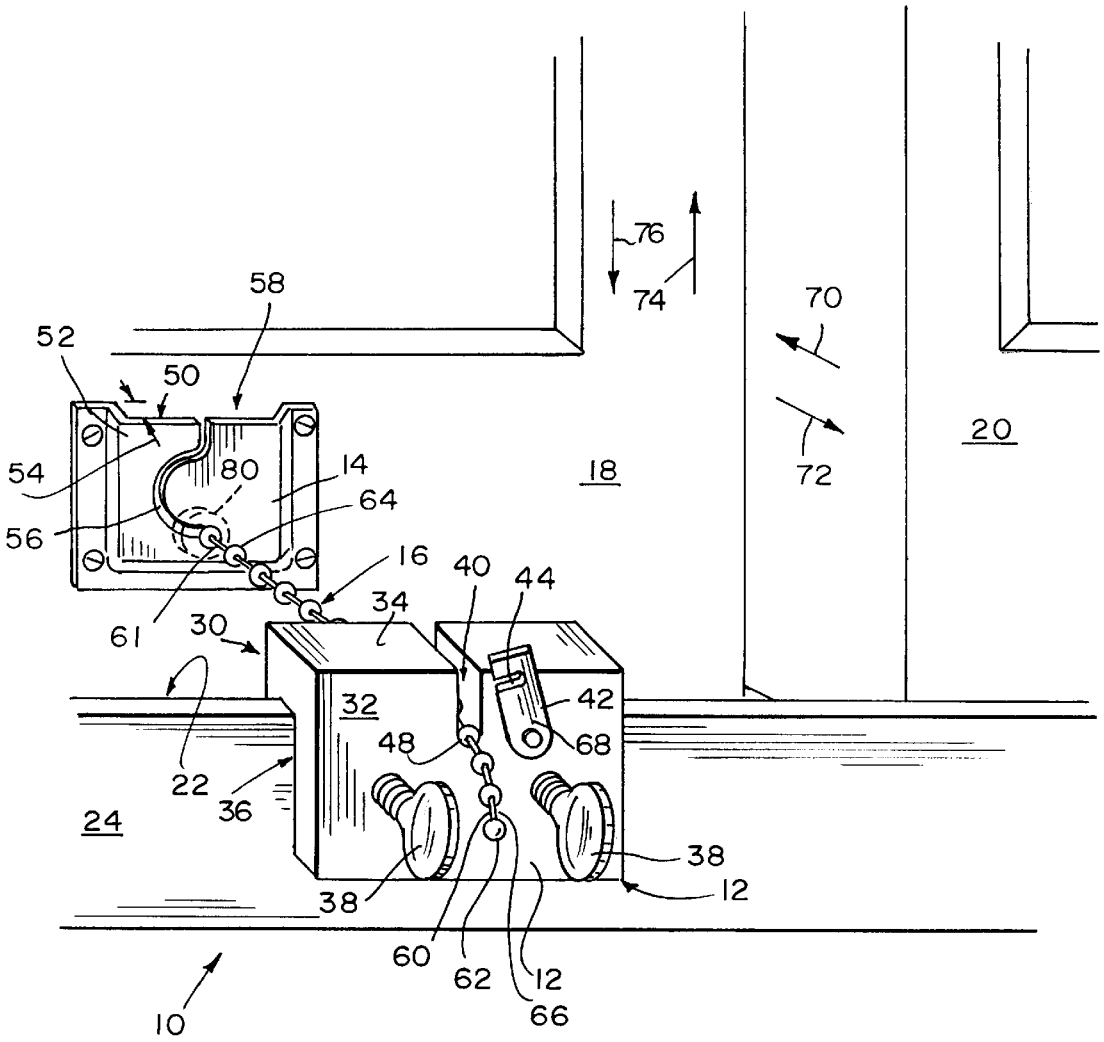
FIG. 1 is a perspective view of an interior sliding door, an exterior sliding door, and a bottom track in which the sliding doors slide and a first embodiment of a sliding door locking system in accordance with the present invention, including a slotted bracket mounted to the exterior door, a track attachment, and a chain which provides a secure connection between the slotted bracket and the track attachment.

As shown in FIG. 1, a first embodiment of a sliding door locking system 10 includes a track attachment 12, a slotted bracket 14, and a latch chain member 16 therebetween. Sliding door locking system 10 may be used to secure many configurations of sliding doors. As shown in FIG. 1, a typical sliding door arrangement includes an exterior door 18, an interior door 20, a bottom door track 22, and a track wall 24. Exterior door 18 and interior door 20 both ride in a sliding motion in bottom track 22. Track wall 24 serves as a barrier for bottom door track 22, thereby guiding interior door 20 and concealing the wheels (not shown) on which interior and exterior doors 20, 18 ride.

Track attachment 12 includes an outer wall 30 and an inner wall 32 positioned in parallel relationship to each other and a top wall 34 connecting outer and inner walls 30, 32. Outer wall 30, inner wall 32, and top wall 34 are coupled to define a track-wall-receiving-channel 36. Track attachment 12 fits over track wall 24 with track wall 24 positioned to lie within track-wall-receiving-channel 36. Two attachment bolts 38 may be screwed through inner wall 32 of track attachment 12 to engage track wall 24 directly, thereby securing track attachment 12 to track wall 24. Track attachment 12 further includes a bracing slot 40 having a valley 48, wherein bracing slot 40 divides top wall 34 of track attachment 12 and extends down into inner and outer walls 32, 30 of track attachment 12. Track attachment 12 also includes a lock stop 42, having a stop groove 44, and an outer stop surface 68 and is movably hinged to inner wall 32 of track attachment 12.

Slotted bracket 14 includes an inner surface 50 and an outer surface 52 and is mounted to exterior sliding door 18. Slotted bracket 14 is mounted to exterior door 18 in such a way that inner surface 50 of slotted bracket 14 remains a distance 54 away from exterior door 18. Distance 54 defines a space 58 between inner surface 50 of slotted bracket 14 and exterior sliding door 18. Further, a receiving slot 56 is formed into slotted bracket 14. It should be noted that receiving slot 56 may be formed directly into exterior door 18, thereby eliminating the need for slotted bracket 14. This also holds true for the various slotted brackets identified with respect to other embodiments of the present invention discussed below.

Latch chain member 16 includes first and second ends 64, 66, respectively, and chain links 60 and chain lugs 62. Chain 16 is configured in such a way that chain lugs 62 have a substantially greater diameter than chain links 60. To first end 64 of chain 16 is coupled a disc 80. During use, disc 80 is placed in space 58 between inner surface 50 of slotted bracket 14 and exterior sliding door 18. With disc 80 positioned to lie in space 58, a first link 61 of first end 64 of chain 16 is slid into receiving slot 56 which is sized slightly larger than links 60 of latch chain member 16, but smaller than disc 80.

With first link 61 of latch chain member 16 slid into receiving slot 56, disc 80 and a chain lug 62, one on each side of first link 61, hold latch chain member 16 securely to slotted bracket 14. Disc 80 is positioned to lie in space 58 between exterior door 18 and slotted bracket 14 and chain lug 62 is positioned to lie against outer surface 52 of slotted bracket 14, thereby securing first end 64 of chain 16 to slotted bracket 14. Second end 66 of latch chain member 16 is then placed through bracing slot 40 and positioned to lie in valley 48 so that second end 66 of chain 16 extends beyond inner wall 32 of track attachment 12.

Lock stop 42 is then swung into position over chain 16 so that one chain link 60 is positioned within stop groove 44 of lock stop 42. In this way, chain 16 is secured between valley 48 and stop groove 44. Further, chain 16 is prevented from pulling through bracing slot 40 toward exterior door 18 and out of track attachment 12 because chain lugs 62 are larger than stop groove 44 and, therefore, butt up against outer stop surface 68 of lock stop 42.

With sliding door locking system 10 thus in place, latch chain member 16, secured at first end 64 to slotted bracket 14 and at second end 66 to track attachment 12, secures exterior door 18 relative to track wall 24, thereby preventing exterior door 18 from being moved in an outward direction 70, an inward direction 72, an upward direction 74, or a downward direction 76. It should also be noted that slotted bracket 14 may be mounted on exterior door 18 closer to interior door 20 than is shown in FIG. 1. Latch chain member 16 is thereby positioned to lie adjacent to interior door 20 to prevent relative sliding movement between interior and exterior doors 20, 18 as well as inward, outward, upward, and downward movement of exterior door 18, as already discussed. This also holds true for the various tangs discussed below. While FIGS. 2, 3, 4, and 5 illustrate the various tangs positioned a distance from interior door 20, the tangs may be positioned against the edge of interior door 20, thereby preventing sliding movement of the interior and exterior doors 20, 18, relative to one another.

Figure 2:
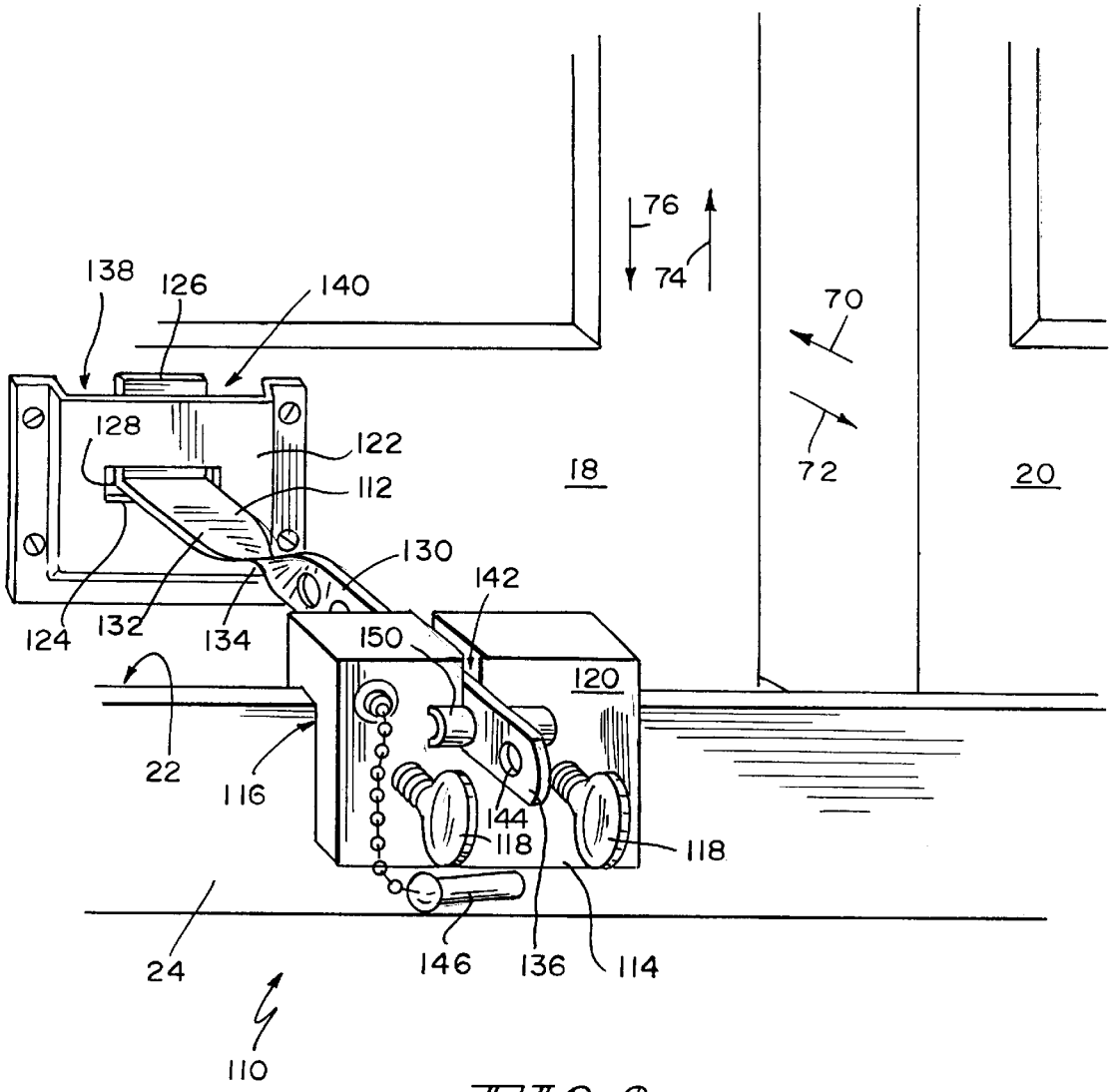
FIG. 2 is a perspective view of the interior sliding door, the exterior sliding door, and the bottom track in which the sliding doors slide and a second embodiment of a sliding door locking system in accordance with the present invention, including a slotted bracket mounted to the exterior door, a track attachment including a lock stop pin chained to the track attachment, and a rigid tang which provides a secure connection between the slotted bracket and the track attachment.

In a second embodiment, shown in FIG. 2, a sliding door locking system 110 is similar to the sliding door locking system 10 shown in FIG. 1, except the embodiment shown in FIG. 2 includes a rigid latch tang member 112 in place of latch chain member 16, shown in FIG. 1. A track attachment 114, shown in FIG. 2, is nearly identical to track attachment 12 of the first embodiment and includes a track-wall-receiving-channel 116, attachment bolts 118, an inner attachment wall 120, and a bracing slot 142. Track attachment 114 fits over track wall 24 so that track wall 24 is positioned within track-wall-receiving-channel 116 and attachment bolts 118 may be screwed through inner attachment wall 120, thereby securing track attachment 114 to track wall 24. A slotted bracket 122, shown in FIG. 2, is also similar to slotted bracket 14 of FIG. 1, except that a receiving slot 124 is configured to receive rigid latch tang member 112 rather than latch chain member 16. In this embodiment, rigid latch tang member 112 includes a bent vertical portion 126, a bend 128, a tang body 130, a horizontal body portion 132, a twist 134, and a vertical body portion 136. Latch tang member 112 is positioned to lie between slotted bracket 122 and track attachment 114, thereby preventing relative movement between the two. As discussed earlier, it should further be noted that slot 124 may be formed directly into exterior door 18 eliminating the need for slotted bracket 122.

In this embodiment, bent vertical portion 126 of latch tang member 112 is positioned through receiving slot 124 of slotted bracket 122 and into a space 140 between slotted bracket 122 and exterior door 18 and is further positioned adjacent to an inner bracket surface 138 of slotted bracket 122. Horizontal body portion 132 of latch tang member 112 is coupled to bent vertical portion 126 at bend 128 and extends out from slotted bracket 122 and away from exterior door 18. Latch tang member 112 further includes twist 134 to provide a transition from horizontal body portion 132 of latch tang member 112 to vertical body portion 136 of latch tang member 112, thereby properly orienting latch tang member 112 to fit latch tang member 112 both through receiving slot 124 and within bracing slot 142 of track attachment 114. Vertical body portion 136 is positioned to lie within bracing slot 142 of track attachment 114 and further includes multiple stop apertures 144 into which a lock stop pin 146 may be placed to prevent vertical body portion 136 from being slid back out through bracing slot 142 and toward exterior door 18. Therefore, latch tang member 112 is secured between slotted bracket 122 and track attachment 114 to prevent outward 70, inward 72, upward 74, and downward 76 movement of exterior door 18 relative to track wall 24. Also, as mentioned above, the entire sliding door locking system 110 may be positioned so that latch tang member 112 is directly adjacent to interior door 20, thereby preventing doors 20, 18, from sliding relative to one another.

Multiple stop apertures 144 facilitate the use of latch tang member 112 with various configurations of sliding doors with varied distances between exterior sliding door 18 and track wall 24. However, if sliding door locking system 110 is to be used only on sliding door configurations with a particular distance between track wall 24 and exterior door 18, then multiple stop apertures 144 are not needed and a fixed stop 150 may be secured to vertical body portion 136 of latch tang member 112, as shown in FIG. 2.

Figure 3:
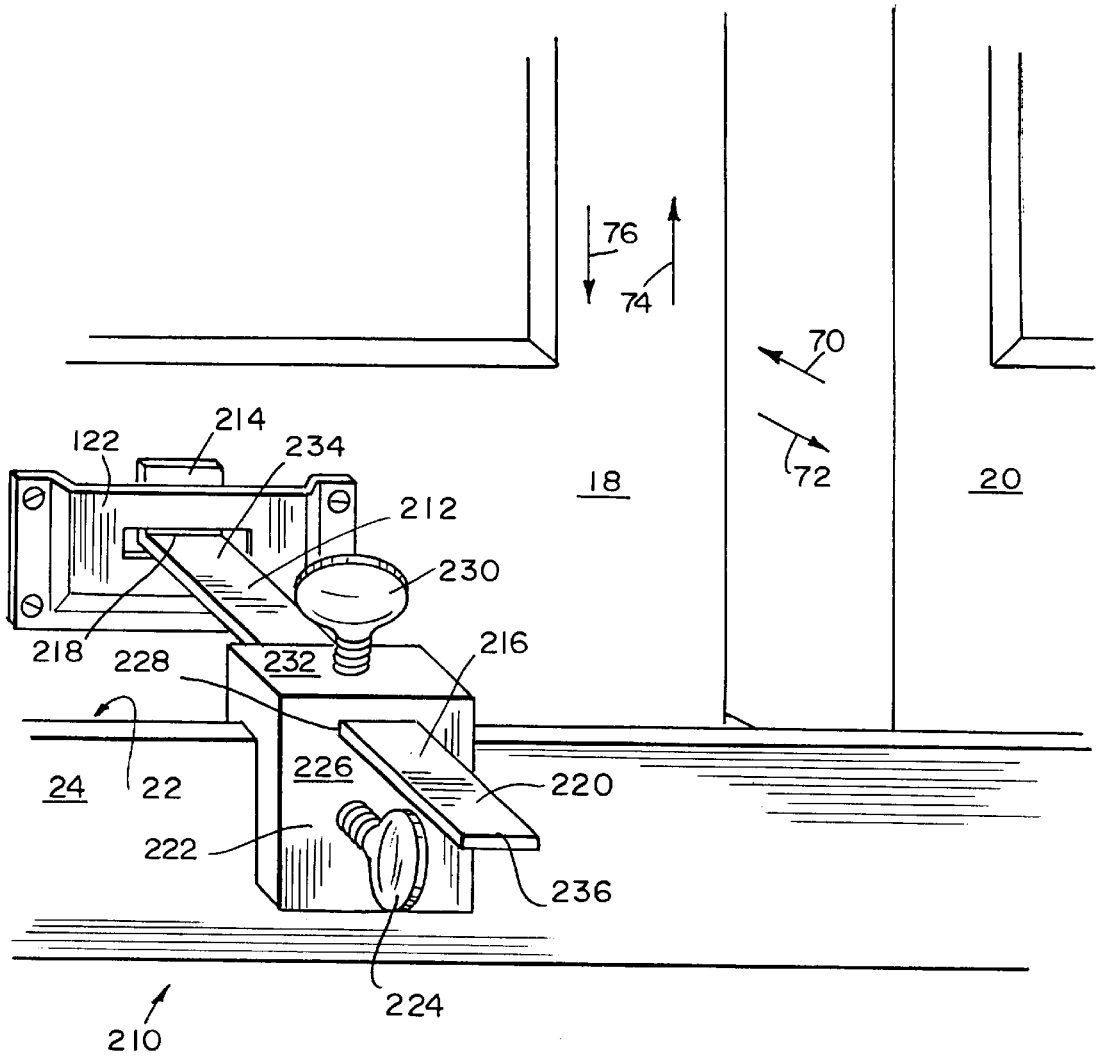
FIG. 3 is a perspective view of the interior sliding door, the exterior sliding door and the bottom track in which the sliding doors slide and a third embodiment of a sliding door locking system in accordance with the present invention, including the slotted bracket of FIG. 2 mounted to the exterior door, a track attachment, and a rigid tang which provides a secure connection between the slotted bracket and the track attachment.

A third embodiment of a sliding door locking system 210 is shown in FIG. 3. In this embodiment, slotted bracket 122 is the same as in FIG. 2 and a latch tang member 212 is similar to latch tang member 112 of FIG. 2 in that it has a bent vertical portion 214 connected to a horizontal body portion 220 by way of a bend 218. Latch tang member 212 further includes first and second tang ends 234, 236. However, latch tang member 212 includes only horizontal body portion 220, rather than the horizontal and vertical body portions 132, 136 of the embodiment shown in FIG. 2.

Sliding door locking system 210 includes a track attachment 222 which is positioned over track wall 24 and secured to track wall 24 using a first attachment bolt 224 which screws through an inner wall 226 of track attachment 222 and against track wall 24. Track attachment 222 further includes a single horizontal bracing slot 228 bored through track attachment 222. Horizontal body portion 220 of latch tang member 212 is positioned through bracing slot 228 and a second attachment bolt 230 is screwed through top attachment wall 232 of track attachment 222 to engage latch tang member 212. In this way, latch tang member 212 is secured to track attachment 222 at second tang end 236 and to slotted bracket 122 at first tang end 234, thereby securing exterior door 18 relative to track wall 24 and preventing inward 72 and outward 70 movement and downward 76 and upward 74 movement of exterior door 18 relative to track wall 24.

Figure 4:
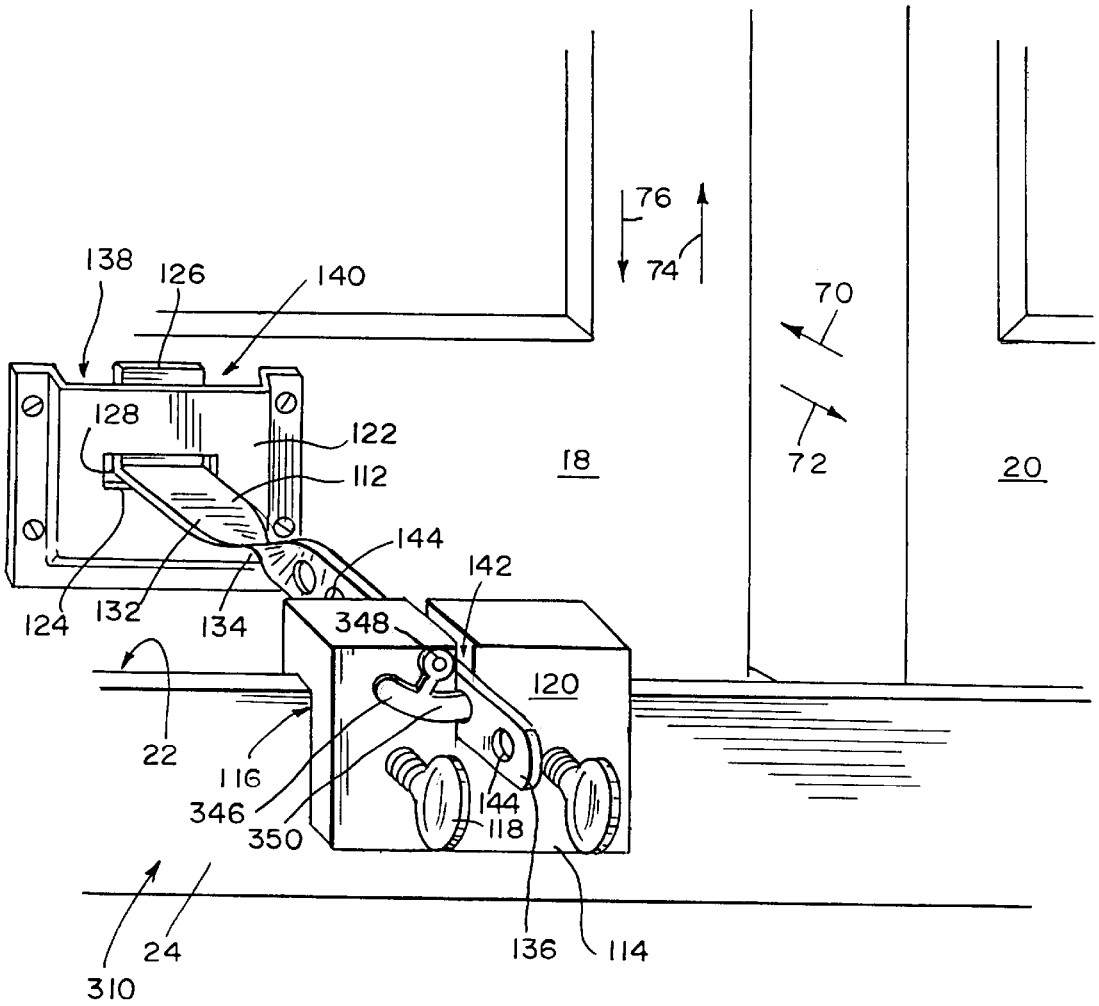
FIG. 4 is a perspective view of the interior sliding door, the exterior sliding door, and the bottom track in which the sliding doors slide and a fourth embodiment of a sliding door locking system in accordance with the present invention, including the slotted bracket of FIG. 2 mounted to the exterior door, a track attachment including a lock stop pin hinged to the track attachment, and the rigid tang of FIG. 2 which provides a secure connection between the slotted bracket and the track attachment.

A fourth embodiment of sliding door locking system 310 is shown in FIG. 4. In this embodiment, almost all the parts are identical to those shown in sliding door locking system 110, shown in FIG. 2. Therefore, the reference numerals used in FIG. 2 will also be used in FIG. 4. The only difference between sliding door locking system 310, shown in FIG. 4, and sliding door locking system 110, shown in FIG. 2, is that in place of lock stop pin 146 which is chained to track attachment 114, as shown in FIG. 2, sliding door locking system 310, shown in FIG. 4, includes a lock stop pin 346 which is hinged to track attachment 114. Lock stop pin 346, shown in FIG. 4, includes a hinge 348 and a bowed pin 350. The entire lock stop pin 346 is coupled to track attachment 114 via hinge 348. During use, bowed pin 350 may be swung into and out of stop apertures 144 by rotating lock stop pin 346 around hinge 348. In this way, bowed pin 350 of lock stop pin 346 engages any of multiple stop apertures 144 to secure vertical body portion 136 of latch tang member 112 within bracing slot 142 of track attachment 114, thereby preventing inward 72 and outward 70 movement and upward 74 and downward 76 movement of exterior door 18 relative to track wall 24.

Figure 5:
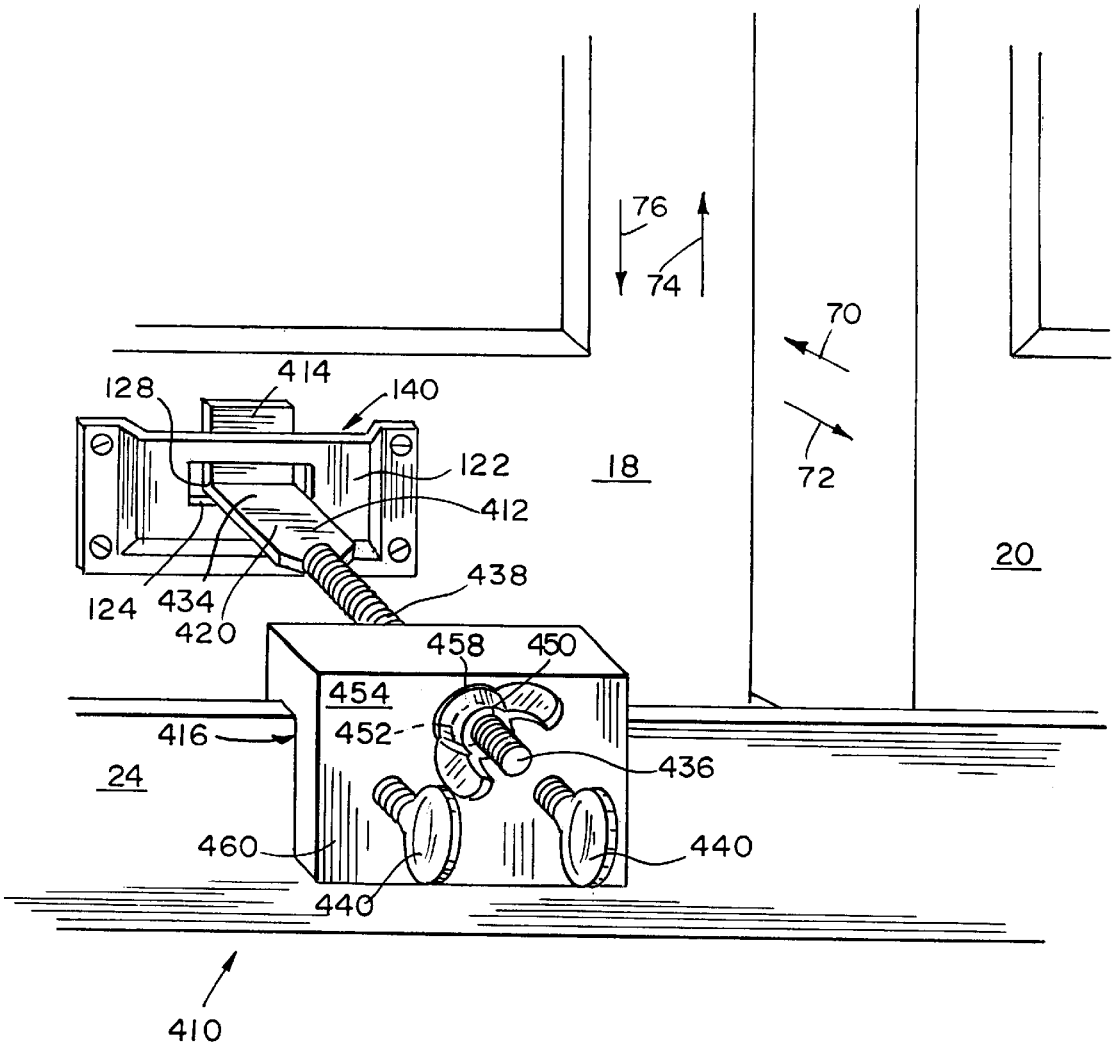
FIG. 5 is a perspective view of the interior sliding door, the exterior sliding door and the bottom track in which the sliding doors slide and a fifth embodiment of a sliding door locking system in accordance with the present invention, including the slotted bracket of FIG. 2 mounted to the exterior door, a track attachment, and a rigid tang which provides a secure connection between the slotted bracket and the track attachment.

A fifth embodiment of a sliding door locking system 410 is shown in FIG. 5. In this embodiment, slotted bracket 122 is again the same as in FIG. 2 and a latch tang member 412 is similar to latch tang member 112 of FIG. 2 in that it has a bent vertical portion 414 connected to a horizontal body portion 420 of latch tang member 412 by way of a bend 418. Latch tang member 412 further includes first and second tang ends 434, 436. However, latch tang member 412 includes a threaded rod portion 438 coupled to horizontal body portion 420, rather than vertical body portion 136 which is coupled to horizontal body portion 132, as shown in FIG. 2.

In this embodiment a track attachment 460, shown in FIG. 5, includes a track-wall-receiving-channel 416, attachment bolts 440, an inner attachment wall 454, and a bracing bore 452. Track attachment 460 fits over track wall 24 so that track wall 24 is positioned within track-wall-receiving-channel 416 and attachment bolts 440 may be screwed through inner attachment wall 454, thereby securing track attachment 460 to track wall 24. In this embodiment, threaded rod portion 438 of latch tang member 412 is positioned within bracing bore 452 of track attachment 460 and bent vertical portion 414 of latch tang member 412 is fitted through receiving slot 124 of slotted bracket 122 and into space 140 between slotted bracket 122 and exterior door 18. A wing nut 450 is then threaded onto threaded rod portion 438 at second tang end 436. Wing nut 450 may be threaded onto threaded rod portion 438 of latch tang member 412 and tightened until it butts up against inner attachment wall 454 thereby firmly securing exterior door 18 to track wall 24 and preventing inward 72 and outward 70 movement and upward 74 and downward 76 movement of exterior door 18 relative to track wall 24. Lastly, a washer 458 may be positioned between inner attachment wall 454 and wing nut 450.

As noted throughout, it should be recognized that all embodiments of the present invention prevent inward 72 and outward 70 movement and upward 74 and downward 76 movement of exterior door 18 relative to track wall 24. And, all embodiments of the present invention may be positioned to further prevent doors 18, 20 from sliding relative to one another.

While the drawings reference a sliding door, it should be recognized that the door could be a framed door with glass panel, a solid door such as a cabinet door, a garage door, a sliding panel on a window. Also, while the truck is shown at the bottom of the door, it could be located at the top of the door.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A locking system for preventing movement of a panel slideable along a track along any of the X, Y, and Z axes comprising:

a bracket member mounted to a sliding panel:

an attachment member mounted to a sliding panel track;

first securement members contacting the bracket and the sliding panel for directly mounting the bracket member to the sliding panel;

second securement means contacting the attachment member and the sliding panel track for directly mounting the attachment member to the sliding panel track;

an latch member connected to the bracket member and attachment member to prohibit vertical movement of the panel with respect to the attachment member (Y axis), sliding movement of the panel along the track (X axis) and horizontal movement of the panel away from the track (Z axis).

2. The locking system of claim 1, wherein the second securement means for attachment member is provided by screws.

3. The locking system of claim 1, wherein the latch member is a chain configured to be attached to the bracket member adjacent one end and to the attachment member adjacent another end.

4. The locking system of claim 3, wherein attachment of the chain to one of the bracket member and attachment member utilizes a slot located on one of the bracket and attachment members into which the chain can be inserted.

5. The locking system of claim 3, wherein the bracket and the attachment members each have a slot to which the chain can be inserted.

6. The locking system of claim 3, wherein the chain is attached to one of the bracket and attachment members by a slotted portion of the one of the bracket and attachment members that partially encloses a connector portion of the chain.

7. The locking system of claim 3, wherein the second securement means for attachment member is provided by screws.

8. The locking system of claim 1, wherein the latch member is a rigid bar.

9. The locking system of claim 8, wherein the bar is L-shaped and the short leg of the L-shaped bar is inserted into a slot formed in the bracket member to provide the connection to the bracket member.

10. The locking system of claim 8, wherein the rigid bar is provided with a hole therein into which a pin attached to the attachment member is inserted to provide the connection to the attachment member.

11. The locking system of claim 9, wherein the rigid bar is provided with a hole therein into which a pin attached to the attachment member is inserted to provide the connection to the attachment member.

12. The locking system of claim 10, wherein the pin is rotatively secured to the attachment member to provide the attachment thereto.

13. The locking system of claim 11, wherein the pin is rotatively secured to the attachment member to provide the attachment thereto.

14. The locking system of claim 10, wherein the pin is chained to the attachment member to provide the attachment thereto.

15. The locking system of claim 11, wherein the pin is chained to the attachment member to provide the attachment thereto.

16. The locking system of claim 8, wherein the rigid bar connection to the attachment member is through a screw threaded into the attachment member.

17. The locking system of claim 9, wherein the rigid bar connection to the attachment member is through a screw threaded into the attachment member.

18. The locking system of claim 8, wherein the rigid bar has a rounded portion provided with screw threads which is inserted into the attachment member and secured thereto by a nut threaded thereon.

19. The locking system of claim 9, wherein the rigid bar has a rounded portion provided with screw threads which is inserted into the attachment member and secured thereto by a nut threaded thereon.

20. The locking system of claim 8, wherein the second securement means for attachment member is provided by screws.

* * * * *